US005316229A

United States Patent [19]

Draghetti

[11] Patent Number: 5,316,229

[45] Date of Patent: May 31, 1994

[54] DEVICE FOR TAKING UP THE LEADING END OF A NEW ROLL OF STRIP MATERIAL AND TRANSFERRING IT TO A SUCCESSIVE WORK STATION

[75] Inventor: Fiorenzo Draghetti, Medicina, Italy

[73] Assignee: G.D. SpA, Bologna, Italy

[21] Appl. No.: 1,629

[22] Filed: Jan. 7, 1993

[30] Foreign Application Priority Data

Jan. 9, 1992 [IT] Italy ..... BO92A000003

[51] Int. Cl.[5] ..... B65H 19/10

[52] U.S. Cl. ..... 242/58; 242/78.8

[58] Field of Search ..... 242/58, 58.1, 58.2, 242/58.3, 58.4, 58.5, 58.6, 78.8, 55

[56] References Cited

U.S. PATENT DOCUMENTS

| | | | |
|---|---|---|---|
| 4,466,577 | 8/1984 | Focke et al. | 242/58 |
| 4,688,736 | 8/1987 | Brinker et al. | 242/78.8 X |
| 4,695,007 | 9/1987 | Muto et al. | 242/58.4 |
| 4,721,263 | 1/1988 | Miyazaki | 242/78.8 X |
| 4,821,971 | 4/1989 | Watanabe et al. | 242/78.8 X |
| 4,840,320 | 6/1989 | Shigeta et al. | 242/78.8 X |
| 4,984,750 | 1/1991 | Shigeta et al. | 242/78.8 X |
| 5,096,134 | 3/1992 | Sakano | 242/78.8 X |

FOREIGN PATENT DOCUMENTS

| | | |
|---|---|---|
| 3538893 | 5/1986 | Fed. Rep. of Germany . |
| 3334 | 2/1983 | Italy . |
| BO9-1A000051 | 2/1991 | Italy . |
| 2164635 | 9/1985 | United Kingdom . |
| 2135283 | 1/1986 | United Kingdom . |
| 2168953 | 7/1986 | United Kingdom . |

*Primary Examiner*—John M. Jillions
*Attorney, Agent, or Firm*—Cushman, Darby & Cushman

[57] ABSTRACT

With the new roll of strip material supported in readiness and free to rotate about its own axis, the leading end of the strip is taken up and traversed in the direction of a successive work station by an aspirating roller, rotatable about an axis parallel to the axis of the roll, designed to attract and hold the strip before releasing it onto an aspirating conveyor belt by which the transfer to the work station is completed; the roller is capable of movement, piloted by a sensor positioned to detect the passage of the leading end, at least between a first operating position of tangential contact with the roll in which the roll is set in rotation and the leading end of the strip attracted and held, and a second operating position in which the strip is cut by a blade and the trimmed end then taken up by the aspirating belt and directed toward the successive work station.

7 Claims, 3 Drawing Sheets

DEVICE FOR TAKING UP THE LEADING END OF A NEW ROLL OF STRIP MATERIAL AND TRANSFERRING IT TO A SUCCESSIVE WORK STATION

BACKGROUND OF THE INVENTION

The present invention relates to a device for taking up the leading end of a new roll of strip material and transferring it to a successive work station.

Italian patent application no 3334 A/83 discloses a machine capable of replacing a first roll of strip material with a second roll automatically, provided that the leading end of the new roll is arranged by hand previously in a prescribed take-up position.

If a higher level of automation is to be achieved, on the other hand, the machine must be capable of positioning the leading end of the new roll in the take-up configuration without manual assistance. In effect, there are various examples of apparatus in current use capable of performing this operation automatically.

A first apparatus of the general type in question, disclosed and claimed in U.S. Pat. No. 4,695,007, comprises a rotating disk supporting a pair of rolls disposed mutually parallel and in diametrical opposition relative to the axis of the disk, a cutting device by means of which to break the seal of the new roll (typically, a sticker by which the leading end of the new strip is secured to the cylindrical surface of the roll), feed means by which the leading edge of the new strip is carried forward and positioned, and a station at which the leading end of the new strip is cut and spliced to the trailing end of the strip currently in use by relative devices. The rolls themselves, one normally in use and the other standing by as its replacement, can be driven about respective axes disposed parallel to the axis of rotation of the supporting disk, turning in both directions concurrently with feed and positioning means that consist in a plurality of mini-conveyor belts positioned with one end beneath the new roll.

The cutting device, positioned beneath and in close proximity to the new roll, comprises a first swing arm rotatable about an axis parallel to that of the disk and carrying a roller designed to enter into tangential contact with the roll, means by which to sense the sticker, and a second swing arm pivotably associated with the first swing arm, rotatable about an axis perpendicular to the axis of the disk and carrying a blade capable of motion in a plane substantially tangential to the new roll in such a way as to intercept and sever the sticker. The splicing device, which extends from the end of the mini-conveyor belts remote from the new roll, comprises a bar capable of swinging transversely to the direction of movement of the belts. Such a bar exhibits a plurality of holes connected to a source of negative pressure and is capable of movement, produced by respective supporting arms, between a lowered receiving position, in which the surface of the bar functions as an extension of the conveyor belts, and a raised operating position in which the leading end of the strip taken up from the new roll is pressed, together with the trailing end of the strip uncoiled from the depleted roll, against a heated reaction bar. The device further comprises a cutter, positioned alongside the heated reaction bar, by which the depleted strip is intercepted at a point preceding this same bar in relation to the direction followed by the running strip.

At the moment when a roll change occurs, the first arm is rotated to bring the roller and the blade into contact with the surface of revolution of the new roll, the sensing means are activated, and the new roll is set in rotation concurrently with its coiling direction and with the blade skimming the surface. As the sticker is detected by the sensing means, the direction of rotation of the new roll is reversed; the sticker then rotates back toward the cutting edge of the blade, which penetrates between the leading end of the strip and the coil beneath. The activation of the second swing arm now causes the blade to cut through the sticker and free the leading end of the strip whereupon the first arm is returned to its at-rest position, distanced from the roll, and the roll is rotated further in the uncoiling direction. At the same time, the conveyor belts are set in motion, running concurrently and synchronously with the rotation of the roll, in such a way that the roll gradually uncoils and the leading end of the strip is supported and advanced by the belts until encountering further sensing means. Next, the direction of movement both of the conveyor belts and of the roll is reversed in order to position the leading end of the strip correctly on the splicing bar, suction is generated to ensure the stable retention of the strip against the bar, and the splicing bar is raised to a position of interaction with the heated reaction bar, which proceeds to unite the leading end of the new strip with the trailing end of the strip in use. Finally, the cutter is activated to trim off the end of the depleted strip.

In a second apparatus of similar type, disclosed in German patent application no. 35 38 893, the leading end of the new roll of strip is fastened with dabs of gum rather than by a sticker. This apparatus comprises means for separating the gummed surfaces and then holding and advancing the leading end of the new roll; such means consist in a penetrating gripper with two spring loaded jaws, one of which exhibiting a tapered end designed to function as a scraper, the other interacting with the tapered end of the first. More exactly, the first jaw affords a seating to receive one end of the second jaw, of which the relative springs ensure that the first jaw is maintained in a given position.

The penetrating gripper is capable of movement between a first position in which the new roll of strip material, carried by a rocker arm together with the roll in use, is moved into contact with the first jaw, and a second position in which the leading end of the new strip is transferred by the gripper to a device that holds the strip and feeds it on to a successive device by which the leading end is spliced to the trailing end of the depleted strip. At the moment of a changeover, the new roll is moved alongside the penetrating gripper, which will be stationary in the first position, and then set in rotation about its own axis in the uncoiling direction. The first jaw of the gripper continues to occupy the same position until its tapered end, riding against the surface of revolution of the new roll, encounters the leading end of the strip. At this point, the slender edge of the jaw slips under the gummed leading end of the strip and detaches it, levering against the force of the springs which maintain the normal configuration of the gripper. Thereupon, the second jaw snaps against the first, under the action of the relative spring, thereby restraining the leading end of the new strip. The gripper then moves to the second position, where the end of the strip is transferred to the hold and feed device.

The types of apparatus described above are somewhat complicated, structurally and functionally. The object of the present invention is to provide a device of the type in question, such as will ensure simplicity and economy both in construction and in operation.

SUMMARY OF THE INVENTION

The stated object is realized, according to the present invention, in a device for taking up the leading end of a continuous strip of material from a new roll, supported with freedom to rotate about its own axis of revolution, and transferring it to a successive work station.

The device disclosed comprises first suction means rotatable about an axis parallel to the axis of the roll, by which the roll itself is set in rotation and by which the leading end of the strip is taken up from the new roll, held and transferred, also second suction means by which the leading end of the strip is received, held and advanced toward the successive work station.

The first suction means are capable of movement, brought about through the intervention of sensing means designed to detect the passage of the leading end, at least between a first operating position of tangential contact with the roll, in which the roll is set in rotation and the leading end of the strip attracted and held, and a second operating position in which the leading end of the strip is exposed to the action of cutting means and the newly cut end thereupon taken up by the second suction means and directed toward the successive work station.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Referring to the accompanying drawings, 1 denotes the device according to the present invention, in its entirety, which is associated with an apparatus serving to replace a first roll of strip material, nearing final depletion, with a second, new roll. Such apparatus comprises a supporting member 16 of disk-like embodiment mounted rotatably to a central pivot (not illustrated) and affording pivots 35 and 36 on which to position two respective rolls 2 and 23, diametrically opposed and with axes of rotation parallel to the central pivot.

Figure 1:
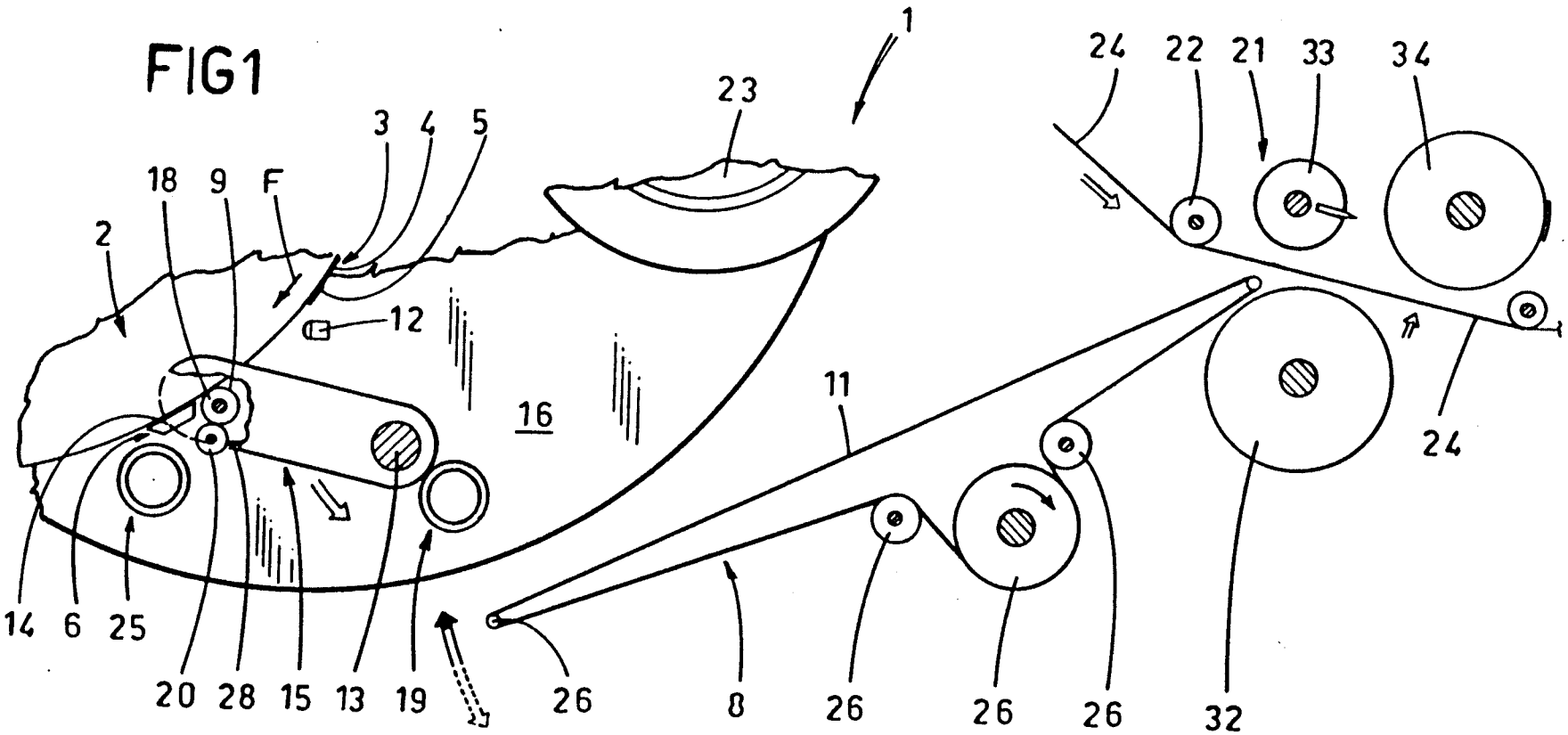
FIGS. 1, 2 and 3 are elevations showing the device according to the invention, seen with certain parts omitted better to reveal others and viewed in three successive operating configurations.

The roll denoted 23, visible on the right in FIG. 1, is the roll currently in use, the remaining roll 2 being positioned on its pivot in readiness. The two rolls 2 and 23 consist in relative coiled strips 3 and 24 of material of which the latter is diverted by a freely revolving roller, or idler 22, into a work station 21 equipped with an accelerating drive roller 32, a rotary cutter 33 and a dispenser 34 of stickers, conventional in embodiment, by which the strips are cut and spliced.

Generally speaking, the strip 3 of the new roll 2 is arranged with the leading end 4 either coiled freely, or alternatively, secured to the surface of revolution of the roll 2 by means of a sticker 5. The supporting member 16 carries two pairs of idle rollers 19 and 25 positioned on opposite sides of the central pivot, between the rolls 2 and 23, of which the latter 25 serves to divert the relative strip 24 toward the idler 22 of the work station. The two rolls 2 and 23 are freely rotatable on the respective supporting pivots 35 and 36.

The device 1 disclosed comprises suction means 9 by which the roll 2 is set in motion and the leading end 4 of the strip taken up, held and transferred to further suction means 8, by which the leading end 4 is in turn held and directed toward the work station 21.

In the event that the leading end 4 of the strip 3 is fastened against the surface of revolution of the roll 2 by means of a sticker 5, the device will additionally comprise means 6 serving to distance the leading end 4 from the roll 2 and cut through the sticker 5. By way of example, suitable cutting means might be of the type disclosed in application no BO91A 000051 for Italian patent, which comprise a blade 14 breasted in contact with the roll 2 and affording a cutting edge of V shape directed toward the leading end 4 of the strip 3. Thus, when the roll 2 is invested with movement in the uncoiling direction, the divergent edges of the blade 14 slip beneath the leading end 4 of the strip 3, thereby intercepting and slicing through the sticker 5. If there is no sticker 5, the blade 14 serves simply to detach the leading end 4 of the strip 3 from the roll. In either case, the blade 14 is positioned alongside and immediately beyond the first suction means 9, considered in relation to the direction of rotation of the roll 2 when in motion (the manner of rotation to be described in due course).

Figure 4:
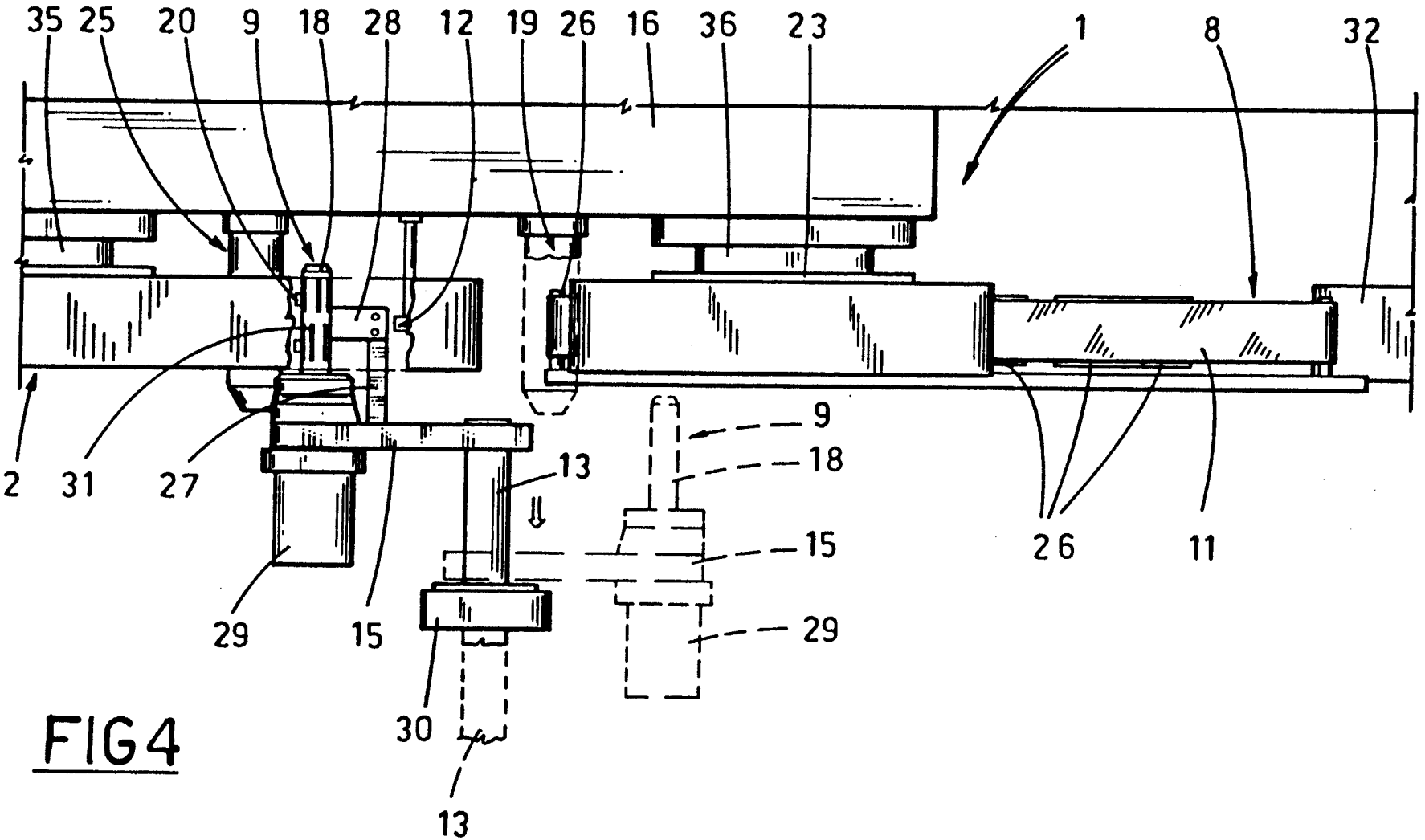
FIG. 4 is a plan view of the device of FIG. 1, seen with certain parts omitted better to reveal others.

The first suction means 9 consist in a cylindrical aspirating roller 18 affording peripheral suction holes 31 and driven by a motor 29 (see FIG. 4) about an axis parallel to the axis of the roll 2. The aspirating roller 18 and the motor 29 are carried by one end of an arm 15 rigidly associated with a rod 13 supported by a bracket 30 anchored to the frame of the roll change apparatus. The rod 13 is disposed parallel to the axis of rotation of the roll 2 and capable of both axial and angular motion brought about by drive means, not illustrated in the drawings. More exactly, rotation of the rod 13 causes the arm 15 to alternate between a first, take-up limit position, in which the aspirating roller 18 is maintained in contact with the surface of revolution of the roll 2, and a second limit position in which the strip 3 is cut and released, whereas the axial movement of the rod 13 results in the aspirating roller 18 being advanced toward the point of contact with the surface of revolution of the roll 2 (bold line in FIG. 4), or distanced in such a way that the supporting member 16 is free to rotate and switch the rolls 2 and 23 (phantom line in FIG. 4).

Figures 2, 3:
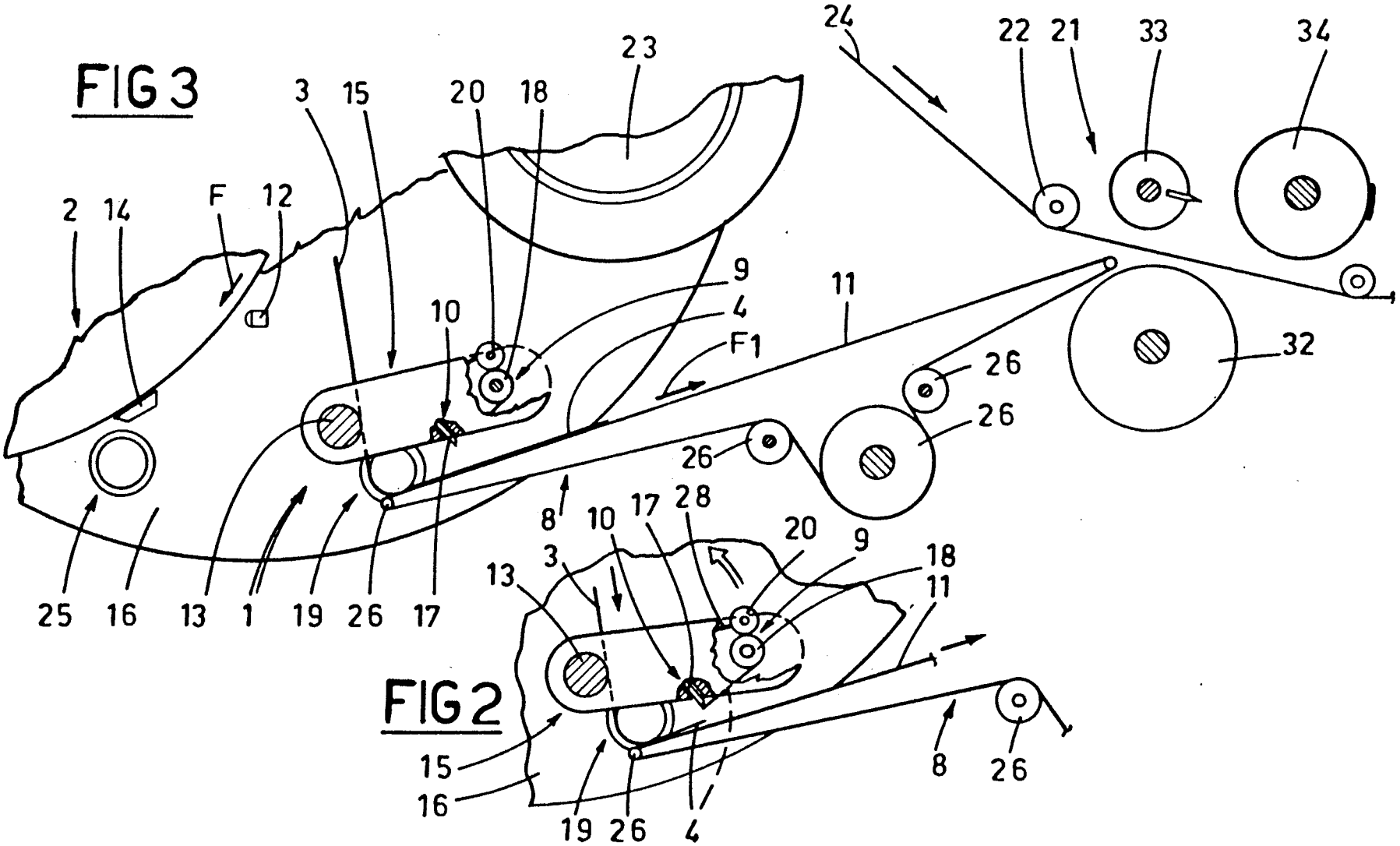

The rod 13 is positioned adjacent to the lower of the two idlers 19 and 25 carried by the disk, i.e. that denoted 19, situated in such a way that when the aspirating roller 18 swings from the first to the second limit position, the leading end 4 of the strip 3 is constrained to pass around the idler 19 as illustrated in FIGS. 2 and 3.

The device comprises cutting means 10 between the lower idler 19 and the aspirating roller 18, with the latter stationary in its second limit position, consisting in a blade 17 of which the cutting edge is engaged by the leading end 4 of the strip as the roller 18 moves toward the second limit position (see FIG. 2).

The second suction means 8, positioned below the lower idler 19, consist in an aspirating conveyor belt 11 looped around a plurality of pulleys 26 of which one is power driven and another positioned at the entry point to the cut and splice station 21. The pulleys 26 are disposed with axes parallel to the axis of rotation of the supporting member 16 and carried by a frame, not illustrated, pivoted at one end about the axis of the pulley 26 positioned at the entry to the cut and splice station 21, as discernible in FIGS. 1 and 3. The aspirating belt 11 is connected to a source of negative pressure not illustrated in the drawings, and set in motion by drive means, likewise not illustrated.

The frame of the aspirating belt 11 is capable of movement between a lowered limit position, shown in FIG. 1, and a raised limit position shown in FIGS. 2 and 3.

The motor 29 and the drive means associated with the rod 13 and the frame of the aspirating belt 11 are interlocked to sensing means 12 positioned and operating adjacent to the surface of revolution of the roll 2 and preceding the aspirating roller 18, considered in relation to the roller when occupying its first limit position, and to the direction of rotation of the roll 2 when set in motion by the roller 18. Such means 12 are designed to sense the passage of the leading end 4 of the strip and/or of the sticker 5 by which it is secured.

To ensure a better grip on the leading end 4 of the strip by the aspirating roller 18, the arm 15 also affords a smaller arm 27 disposed parallel to the rod 13 and carrying a flexible plate 28 with which two freely revolving rollers 20 are associated; the rollers 20 are offered in direct contact to the aspirating roller 18, and more exactly, positioned in contact with a bottom generator of the roller 18 when the roller 18 itself is in tangential contact with the surface of the roll 2.

The operation of the device 1 will now be described with reference to the drawings, departing from a situation in which the depleting roll 23 occupies the side of the supporting member 16 nearest the work station 21 and a new roll 2 has been mounted in readiness to the respective pivot 35.

In this configuration, the aspirating roller 18 is held by the rod 13 in the second limit position, distanced from the supporting member 16. At a given stage of depletion reached by the roll 23 about to be replaced, detected by conventional sensing means (not illustrated) forming part of the roll change apparatus, the sensing means 12 of the device will be activated through the agency of monitoring and control means (likewise not illustrated), by which the rod 13 is also piloted to direct the aspirating roller 18, and the blade 14 if appropriate, into contact with the surface of revolution of the new roll 2. Thereupon, the aspirating roller 18 is set in rotation, thus causing the roll 2 to turn on its axis in the uncoiling direction as indicated by the arrow denoted F in FIG. 1.

Having registered the passage of the leading end 4 of the strip 3 or of the sticker 5, following which there is a delay of duration sufficient for the end or sticker to reach the aspirating roller 18, the sensing means 12 will generate a signal to connect the roller 18 with its source of negative pressure. The leading end 4 duly enters into contact with the aspirating roller 18, at which point the sticker 5 (if present) will be intercepted and cut through by the blade 14 and then begin to envelop the surface of the roller 18. Once a certain number of coils of the leading end 4 of the strip 3 have formed around the aspirating roller 18, assisted by the freely revolving rollers 20 (see FIGS. 2 and 3), the rod 13 rotates on its axis to transfer the roller 18 from the first to the second limit position. As a result of this excursion, the leading end 4 of the strip passes over the lower idler 19 and, substantially on completion of the movement, is intercepted and severed by the blade 17 associated with the arm 15; at the same time, the aspirating belt 11 is raised and brought into contact with the idler 19. Once the cut has been made, the trimmed leading end 4 is taken up, held, and carried forward by the belt 11 to the point of encountering the accelerating drive roller 32, as indicated by the arrow denoted F1 in FIGS. 2 and 3.

The device will handle a strip 3 even of typically delicate material, for example such as cigarette paper, since the roll 2 is set in motion simply by tangential contact with the aspirating roller 18, and the force of traction to which the strip 3 is subjected thereafter has no effect other than to keep the roll 2 in rotation.

The most evident of the advantages afforded by the device according to the invention is that of its simplicity in construction and operation.

What is claimed:

1. A device for taking up the leading end of a strip of material from a new roll, supported with freedom to rotate about its own axis of revolution, and transferring it to a successive work station, comprising first suction means rotatable about an axis parallel to the axis of the roll, by which the roll is set in rotation and by which the leading end of the strip is taken up from the new roll, held and transferred, and second suction means by which the leading end of the strip is received, held and fed toward the successive work station, wherein the first suction means are capable of movement, brought about through the intervention of sensing means designed to detect the passage of the leading end, at least between a first operating position of tangential contact with the roll, in which the roll is set in rotation and the leading end of the strip attracted and held, and a second operating position in which the leading end of the strip is exposed to the action of cutting means and the newly cut end thereupon taken up by the second suction means and directed toward the successive work station.

2. A device as in claim 1, wherein the first suction means consist in an aspirating cylindrical roller disposed parallel to the axis of revolution of the roll, of which the periphery affords a plurality of suction holes.

3. A device as in claim 2, further comprising freely revolving roller means positioned to intercept the strip when transferred by the aspirating roller in the course of its movement between the first and second operating limit positions, traversing with axis parallel to the axis of revolution of the roll and describing a circular trajectory, wherein the second suction means are capable of movement between an at-rest position, distanced from the freely revolving roller means to allow the passage of the aspirating roller, and an operating position of close proximity to the freely revolving roller means.

4. A device as in claim 3, wherein the second suction means consist in an aspirating belt destined to enter into contact with the freely revolving roller means when occupying the operating position.

5. A device as in claim 1, further comprising at least one freely revolving roller maintained flexibly in contact and operating in conjunction with the first suction means.

6. A device as in claim 1, operating in conjunction with a supporting member designed to carry two rolls of strip material disposed mutually parallel, the one in depletion, the other new, and rotatable about an axis parallel to the axes of revolution of the two rolls, wherein at least the first suction means are further capable of movement toward and away from the supporting member between positions respectively of contact with and detachment from the new roll.

7. A device as in claim 1, utilized in conjunction with rolls of strip material of which the leading end is secured by a sticker, comprising means by which to distance the leading end of the strip from the roll and cut through the sticker, positioned at a predetermined distance from the axis of the new roll and adjacent to the first suction means along the trajectory followed by the sticker in such a way that the sticker will be severed automatically when the roll is set in motion through tangential contact with the rotating first suction means.

* * * * *